US005176560A

United States Patent [19]

Wetherell et al.

[11] Patent Number: 5,176,560

[45] Date of Patent: Jan. 5, 1993

[54] DANCING DOLL

[76] Inventors: Joseph J. Wetherell, 1045 Gulf of Mexico Dr., Longboat Key, Fla. 34228; Larry Reiner, 1 Horizon Rd., Fort Lee, N.J. 07024; Allan Buckwalter, 1020 Race St., Philadelphia, Pa. 19107

[21] Appl. No.: 749,698

[22] Filed: Aug. 26, 1991

[51] Int. Cl.[5] ..... A63H 13/02

[52] U.S. Cl. ..... 446/175; 446/354

[58] Field of Search ..... 446/352-356, 446/236, 246, 175; 40/414

[56] References Cited

U.S. PATENT DOCUMENTS

| | | | |
|---|---|---|---|
| 1,383,780 | 7/1921 | Zaiden | 446/354 |
| 2,637,936 | 5/1953 | Dale et al. | 446/236 X |
| 3,038,275 | 6/1962 | Curci | 446/278 |
| 3,456,383 | 7/1969 | Gardel et al. . | |
| 3,613,299 | 10/1971 | Amici et al. . | |
| 3,710,507 | 1/1973 | Poynter | 446/353 X |
| 4,040,206 | 8/1977 | Kimura | 446/352 |
| 4,129,962 | 12/1978 | Goldner | 446/246 |
| 4,775,351 | 10/1988 | Provenzano, Jr. | 446/278 X |
| 4,869,703 | 9/1989 | Ong | 446/353 |
| 4,875,886 | 10/1989 | Sung | 446/298 |
| 4,903,424 | 2/1990 | Satoh et al. | 40/414 |

*Primary Examiner*—Mickey Yu
*Attorney, Agent, or Firm*—Natter & Natter

[57] ABSTRACT

A free-standing dancing doll having a sound actuated motor and drive mechanism for rotating each of two drive rods extending through the doll. The drive mechanism includes a gear train for simultaneously rotating each of the drive rods at different speeds to impart asymmetric motion to selected doll body parts including the legs, arms, and head, to thereby simulate compound dance movements.

16 Claims, 3 Drawing Sheets

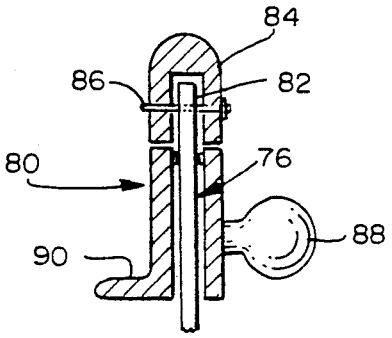
FIG. 2
FIG. 3
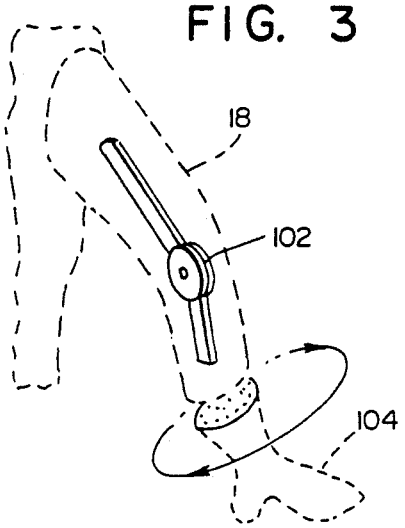
FIG. 4A
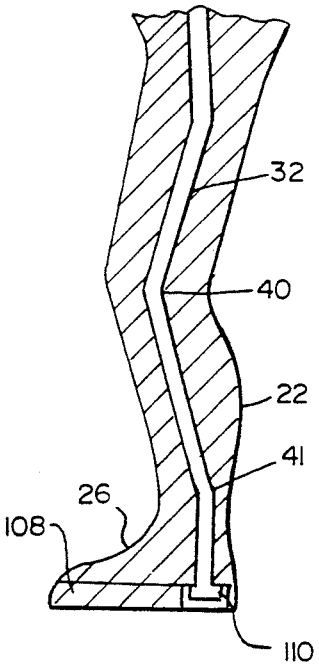
FIG. 4B
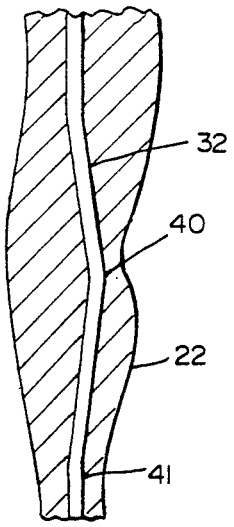
FIG. 5
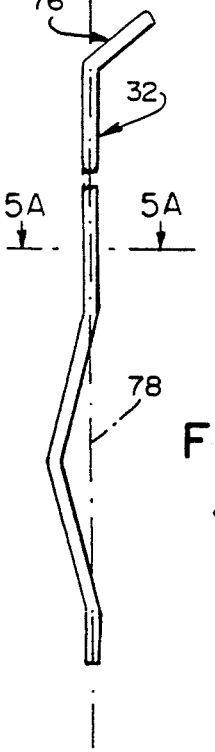
FIG. 5A
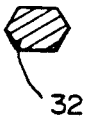

DANCING DOLL

BACKGROUND OF THE INVENTION

1. Field Of The Invention

This invention relates generally to figure toys and especially to a free-standing animated doll that is adapted to simulate the compound movements of a dance performer.

In particular, the dancing doll of this invention concerns the application of asymmetric motion to corresponding doll-body parts for emulating dance movement.

2. Background Art

Many figure toys and especially dancing dolls, have attempted to imitate the body and limb movements of a dance performer. These toy devices generally incorporate a mechanism that produces repetitive sequences of movements which after a relatively short period of time become familiar to the child and thus detract from the play value. Furthermore, the play pattern of the previous dancing dolls did not provide a realistic dancing companion for interaction with the child.

For example, a mechanically operated ballerina doll such as shown in U.S. Pat. No. 4,040,206 is mounted on a base and employs a linear rod extending from the base through a leg of the doll for transmitting rotary motion. A shortcoming of this doll is that it lacks lifelike imagery since it is not free-standing and does not provide lifelike asymmetric movement.

Another type of dancing doll as illustrated in U.S. Pat. No. 4,875,886, utilizes a drive mechanism having a central column rotatably connected to a base and also employs linkage arms for generating pivotal movement in a cross-shaped member. The doll of that device is similarly not free-standing and does not provide a play pattern wherein the child can interact with a dance counterpart.

A free-standing dancing doll is described in U.S. Pat. No. 1,383,780, however, the spring clock pendulum mechanism of that device only imparts a dancing effect in brief repetitive sequences and is limited solely to agitation of the skirt and leg movement and does not simulate natural dance movement.

An amusement device shown in U.S. Pat. No. 4,775,351, in the form of a fish, has a flexible rotary shaft which is slightly bent and contains eccentrically mounted discs which engage an inner wall to impart lifelike movement. That device however does not disclose plural drive shaft nor does it utilize compound dance movements.

A device for imparting a meandering motion using a single driven element bent to assume a shape that provides a wobbling motion is described in U.S. Pat. No. 4,903,424. The doll disclosed in that patent however is fixed to a base, does not incorporate true to life movement in the arms or legs and does not provide direct interaction with an observer, all in contrast to the doll of the present invention.

BRIEF DESCRIPTION OF THE INVENTION

Briefly, the nature of this invention involves a free-standing mechanical doll having a sound actuated motor and drive mechanism operatively connected to each of two drive rods. The doll torso and limbs are comprised of an elastomeric foam material encased within a pliable skin covering. Each of the drive rods extends substantially longitudinally through a passageway from the shoulder through the leg to the foot of the doll. An upper end of each drive rod is respectively connected to a shoulder joint. Axially rotation of the drive rod imparts lifelike movement to the doll body parts including the hips, legs, feet, arms, hands and shoulders. Additionally, the head oscillates in response to shoulder and body movement. In an alternate embodiment the head is directly linked to the shoulder joint.

A motor and drive mechanism are housed within the body torso and the body components are aligned through the center of gravity to provide a balanced weight distribution for stability.

A feature of this invention is that the dancing doll provides a play-mate for the child to interact with rather than to merely be an observer.

Still another aspect of the invention is that the dance-like movement can be initiated and accompanied by the sound of music which enhances the play pattern.

A further advantage of this invention is that the doll has poseable arms which adds another dimension to the doll play.

In view of the foregoing, it should be apparent that the present invention overcomes many of the shortcomings and deficiencies of the prior art and provides an improved dancing doll.

Having thus summarized the invention, it will be seen that it is an object thereof to provide a dancing doll of the general character described herein which is not subject to any of the aforementioned limitations.

Another object of this invention is to provide a dancing doll having simultaneous movement of plural body parts for simulating a lifelike performer.

A further object of this invention is to provide a dancing doll wherein asymmetric motion is imparted to the several body parts of the doll.

Still another object of this invention is to provide a dancing doll wherein the body motion is initiated by sound actuation.

A still further object of this invention is to provide a dancing doll having free-standing stability.

An additional object of this invention is to provide a dancing doll that is simple in construction, reliable in use, and well adapted for mass production fabrication techniques.

Other objects of this invention will in part be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention:

FIG. 2 is a sectional view of a shoulder joint showing an upper portion of a drive rod engaging a shoulder sleeve;

FIG. 3 is a perspective view of a doll arm in phantom outline showing in partial view, a poseable elbow joint and a detached view of a wrist and hand component;

FIG. 4A is a sectional view of a doll leg illustrating the drive rod positioned therein for effecting leg movement;

FIG. 4B is a sectional view of the doll leg showing the drive rod rotated approximately 180 degrees from the position in FIG. 4A;

FIG. 5 is an isolated view of the drive rod showing a plurality of angularly offset rod segments for controlling motivity in the respective doll components;

FIG. 5A is a cross-sectional view of the drive rod taken substantially along line 5—5.

DETAILED DESCRIPTION OF THE INVENTION

Figure 1:
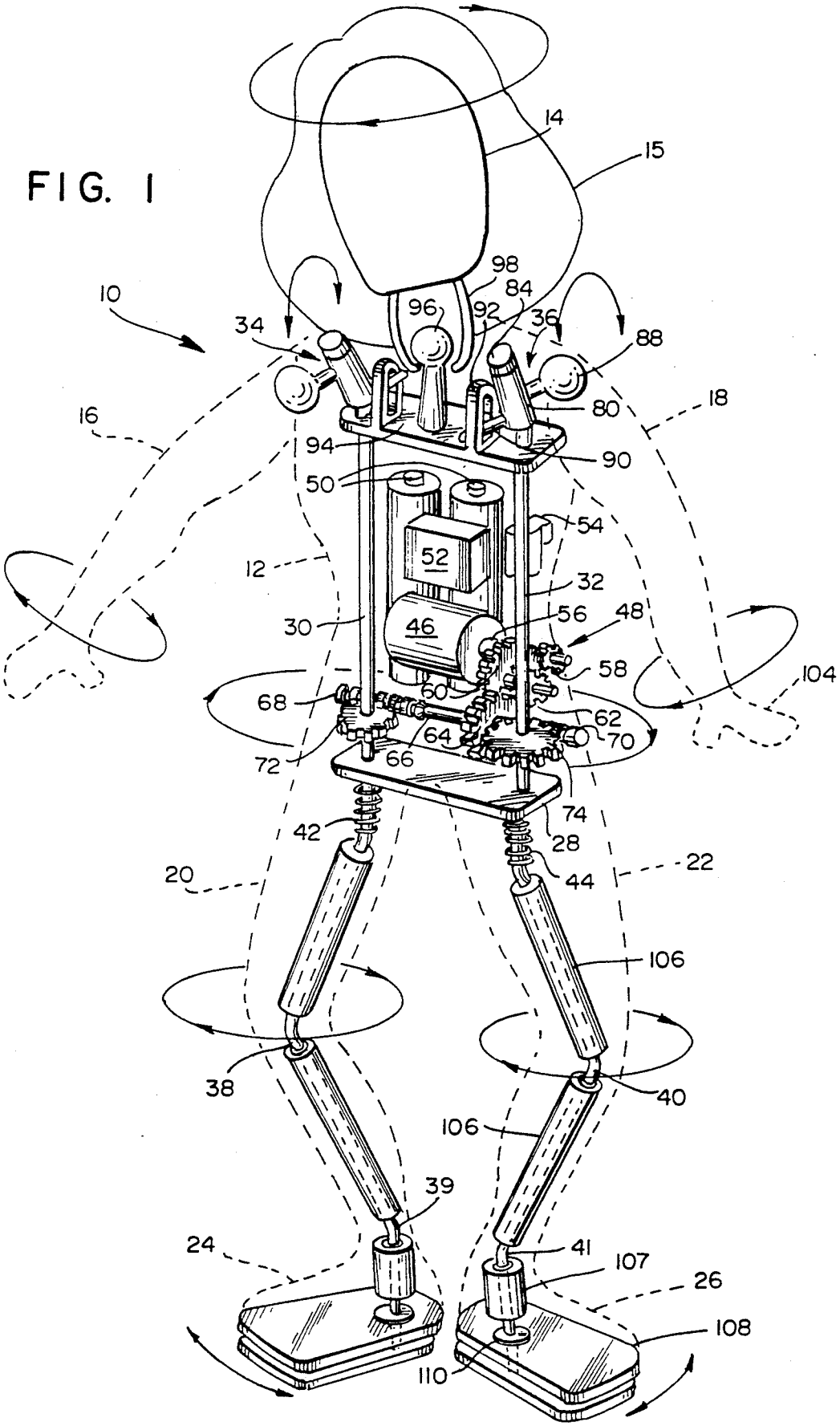
FIG. 1 is a perspective view in phantom outline of a dancing doll in accordance with this invention illustrating a motor and gear train for rotating a set of drive rods.

Referring now in detail to the drawings, the reference numeral 10 denotes generally a dancing doll as encompassed by this invention.

Although this invention will be described hereinafter with reference to a dancing doll, the concept can be applied to other figure toys e.g. animals, as well as to animated figures in advertising displays or novelty devices.

The doll 10 includes a trunk or torso 12, having a pair of arms 16, 18 and a pair of legs 20, 22 and is preferably comprised of a molded foam material. A continuous covering or pliable skin such as vinyl sheet material is applied as an outer covering. Alternatively, in lieu of a foam body the respective body components can be rotationally molded in a flexible vinyl.

A head member 14 is typically fabricated from a lightweight rotationally cast plastic filled with an elastomeric material. To further create a lifelike appearance, an artificial hair portion 15 is rooted to the head 14.

The operating mechanism includes a set of substantially parallel drive rods 30, 32, each drive rod 30, 32 extends from a respective shoulder joint 34, 36 to a respective foot member, 24, 26. The drive rods 30, 32 are preferably manufactured of steel and have angular segments and a hexagonal cross-section as shown in FIGS. 5 and 5A. The width dimension of the rods 30, 32 in this typical embodiment is approximately ⅛ in. and the length dimension is about 12–14 in. The rods 30, 32 can be continuous in length or as shown herein are comprised of a discrete upper torso, and a lower leg portion coupled below a hip plate 28 by a respective coil spring 42, 44 or equivalent connector. The lower portion of the respective drive rods 30, 32 includes a knee bend 38, 40 and an ankle bend 39, 41. The upper portion of the drive rods 30, 32 is angularly offset at the respective shoulder joints 34, 36 as will be discussed hereinafter.

A motor 46 includes a gear train 48, for rotating the drive rods 30, 32. The motor 46, in this exemplary embodiment, is a three (3) volt DC motor that is powered by a battery source 50, for example two AA battery cells housed within a compartment (not shown) that is accessible from the back of the torso 12 for inspection or replacement. It should be noted however, that the battery source 50 can be remotely located other than in the torso 12 but preferably should be self-contained within the doll 10.

A sound activated switch or sensor 52 is used to actuate the motor 46 to response to music or other audible sounds. Alternatively, a mechanical switch 54 can be applied in substitution of or to override the sound sensor 52. The motor 46 can also include internal circuitry and/or a mechanical switch for reversing the polarity and direction of rotation intermittently or on command.

The motor 46 contains an output shaft 56 having a drive gear 58 mounted thereon. The drive gear 58 engages an idler gear 60 which in turn rotates a reduction gear 62. The reduction gear 62 is designed to mesh with a further idler gear 64 that in turn, rotates a shaft 66 having a worm gear 68, 70 at opposite ends thereof. The worm gear 68, 70 engage a respective spur gear 72, 74. The spur gear 72 as shown is mounted on the drive rod 30 and the spur gear 74 is mounted on the drive rod 32. The spur gear 74 includes a greater number of gear teeth than the spur gear 72. Thus the axial rotational velocity of the drive rod 30 is greater than the axial rotational velocity of drive rod 32. This produces asymmetric movement in the doll 10.

The transmission of the axial rotational movement of the drive rods 30, 32 to the doll body components will be discussed with respect to one side of the doll 10. The motility of the respective body components on the opposite side of the doll will be correspondingly similar but not symmetrical.

Considering next the shoulder joint 36, an upper end of the drive rod 32 includes a dogleg or shoulder segment 76 that is angularly offset from a longitudinal axis 78 of the drive rod 32 as best shown in FIG. 5. The shoulder segment 76 rotates within a shoulder sleeve 80 and is converted to eccentric, substantial arcuate movement of the sleeve 80 as it rides with the shoulder segment 76. An end 82 of the shoulder segment 76 is secured by a sleeve cap 84 having a pin connector 86. The cap 84 rotates concurrently with the axial rotation of the drive rod 32 however, the sleeve 80 will tend to follow the circular path circumscribed by the shoulder segment 76. A pin 90 extending from the sleeve 80 is slidably receivable within a slotted projection 92 positioned on a shoulder plate 94 to limit circular movement of the sleeve 80. The shoulder plate 94 also supports a head post 96. The head member 14 includes a neck socket 98 adapted for a loose fitting engagement over the head post 96.

The sleeve 80 further includes a ball-shaped projection 88 for accommodation within a socket or similar receptacle in the arm 18. An articulated elbow member 102 within the arm 18, is adapted for positioning and holding the arm 18 in selected orientations. The arm member 18 is provided with a hand 104 that is formed integrally therewith.

With regard to movement of the upper body components, it should be apparent that the axial rotational displacement of the drive rod 32 and the shoulder segment 76 generates an angularly directed oscillating or rocking motion of the ball-shaped projection 88 which will be transmitted to the arm 18 as a circular motion (as indicated by the arrows) and will also induce movement of the hand 104. It should be noted that the motion generated in the arms 16, 18 and the torso 12 will be transmitted by the foam material surrounding the neck socket 98 and also by the shoulder plate 94 for effecting head motion in the direction of the arrows shown in FIG. 1.

Movement of the lower body components will be discussed hereinafter with respect to one side of the doll 10 it being understood that the corresponding drive rod will produce similar movements. The leg 22 is provided with a longitudinal passageway for accommodating a tubular sleeve 106 having a section above the knee bend 40, and a section below the knee bend 40. An ankle joint 107 is provided below the ankle bend 41. Both, the sleeve 106 and ankle joint 107 are preferably made of plastic material and the drive rod 32 is rotatable within the sleeve 106 and ankle joint 107 to reduce friction between a drive rod 32 and the surrounding foam material within the leg 22. It should be noted that the leg 22 is molded in a slightly bent knee position as best shown in FIG. 4A. As the drive rod 32 rotates, the knee bend 40 moves in a circular motion (as indicated by the arrows in FIG. 1), and the leg 22 gradually assumes a straight-leg position as shown in FIG. 4B, after being rotated through an arc of approximately 180 degrees. It should further be observed that during this rotational movement of the drive rod 32, there is some distortion of the molded foam material within the leg 22 which is translated into the movement of the doll 10 (as indicated by the arrows).

A foot 26 is similarly constructed of molded foam material and includes a foot base 108 that is weighted and sized to support the doll 10 in a standing position and to allow slidable foot movement on a smooth surface. The lowermost portion of the drive rod 32 passes through the ankle joint 107 and the end thereof is locked within the foot base 108 by a toothed washer or equivalent anchor device 110. The anchor device 110 permits rotational movement of the drive rod 32 without disengagement from the foot base 108. The rotational movement of the drive rod 32 displaces the foam material within the foot 26 and further angularly displaces the foot 26 in a repetitive pattern in the directions as indicated by the arrows in FIG. 1. The foot 26 can also be provided with a boot or shoe to conform with suitable doll clothing.

The previously mentioned coil springs 42, 44 act as a shock absorber and thus preventing bending or distortion of the legs 20, 22 and/or drive rods 30, 32 if the doll 10 is dropped. It should further be noted that the hip plate 28, shoulder plate 94, as well as the drive rods 30, 32 can be supported by a brace or frame member extending within the torso 12 and that the drive rod 30, 32 can be journaled through said hip plate 28 and said shoulder plate 94.

Figure 6:
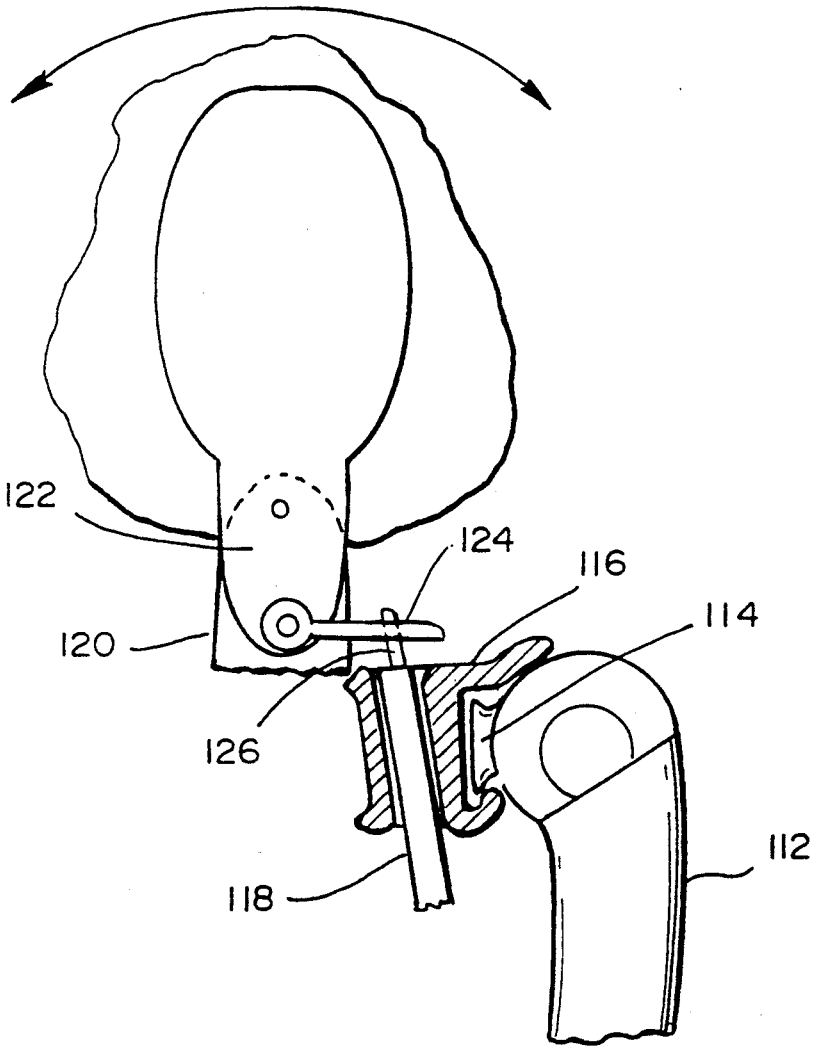
FIG. 6 is a sectional view of an alternate arrangement showing a modified shoulder joint and a linkage to a pivotally mounted head member.

An alternate arrangement for the shoulder joint 36 is shown in FIG. 6 wherein an arm 112 includes a plug 114 preferably made of yieldable material. The arm plug 114 is adapted for accommodation within a shoulder cup 116. An upper end of a drive rod 118 (corresponding to the previously described shoulder segment 76) is adapted to rotate the shoulder cup 116 in the manner similar to that described with regard to the shoulder joint 36. It should further be observed that a head support 120 includes a pivotal connection 122 and a head actuator link 124 for moving a head 126. The actuator link is engaged by an extension pin 126 integral with the rod 118.

Preferably, the respective drive rods 30, 32 should be provided with complementary offset segments such that the arms 16, 18 move in opposite directions to the respective legs 20, 22 to facilitate balancing the doll 10 and to emphasize the motion.

Thus, it should be seen that there is provided a dancing doll which achieves the various objects of this invention and which is well adapted to meet conditions of practical use.

Since various possible embodiments might be made to the present invention or modifications might be made to the exemplary embodiments set forth, it is to be understood that all materials shown and described in the accompanying drawings are to be considered as illustrative and not in a limiting sense.

Having thus described the invention, there is claimed as new and desired to be secured by Letters Patent:

1. A dancing doll comprising a doll body adapted for free-standing on a support surface, said doll body including a head, a torso, a pair of arm members and a pair of leg members, plural drive rods extending through said torso and each of the respective leg members, drive means for axially rotating each of said drive rods simultaneously at different speeds, said rotary motion of the drive rods being translated into asymmetric dance-like movement in the doll body.

2. A dancing doll as claimed in claim 1 further including a first shoulder joint within the torso, an upper portion of at least one of said drive rods being adapted to coact with said first shoulder joint for inducing arm movement.

3. A dancing doll as claimed in claim 2 wherein the first shoulder joint includes a sleeve member, an upper portion of a first drive rod being angularly offset from a longitudinal axis of the first drive rod, said sleeve member being loosely mounted over said upper portion of the first drive rod whereby axial rotation of the first drive rod is translated into an angular oscillatory movement of the sleeve.

4. A dancing doll as claimed in claim 3 wherein the head member includes a depending socket, said socket being adapted for loose fitting engagement with a post support projecting from said torso, the head member being displaceable about the post member during arm and torso movement.

5. A dancing doll as claimed in claim 3 wherein the head member is pivotally mounted, further including linkage means for interconnecting the upper portion of the first drive rod to the head, said linkage means being adapted to displace the head member in response to axial rotation of the first drive rod.

6. A dancing doll as claimed in claim 2 wherein a lower portion of a first drive rod is transversable through a first leg member, an end of the first drive rod being anchored to a foot member, said first drive rod further being adapted to coact with the first leg member and the foot member for generating movement therein.

7. A dancing doll as claimed in claim 6 wherein the first leg member is formed with a knee bend, said first drive rod having a conforming angulation, said first drive rod further being adapted for axial rotation within the first leg member whereby the first leg member transitionally assumes a straight leg position.

8. A dancing doll as claimed in claim 7 wherein the first leg member includes an ankle bend and an ankle joint, with the first drive rod conforming to the ankle bend and being rotationally accommodated within the ankle joint.

9. A dancing doll as claimed in claim 6 further including tubular means within the first leg member for rotatably accommodating the first drive rod.

10. A dancing doll as claimed in claim 9 wherein the first leg member and the foot member are fabricated of molded foam material, the foam material being displaceable during rotational movement of the first drive rod.

11. A dancing doll as claimed in claim 1 wherein the drive means includes a motor mounted within the torso.

12. A dancing doll as claimed in claim 11 wherein the drive means includes a gear train.

13. A dancing doll as claimed in claim 12 including two substantially parallel drive rods, each of said drive rods extending longitudinally through the torso and through each of the respective leg members.

14. A dancing doll as claimed in claim 13 wherein the drive means is sound actuated.

15. A dancing doll as claimed in cl aim 1 wherein the head member, torso and drive means are axially aligned through the center of gravity of the doll to provide free-standing stability.

16. A dancing doll as claimed in claim 6 wherein each of the drive rods is provided with complementary angular offset segments at a respective upper and a lower portion thereof, whereby the respective arm members move in an opposite direction to the respective leg members to facilitate balancing the doll.

* * * * *